US011158939B2

(12) United States Patent
Yilmaz et al.

(10) Patent No.: US 11,158,939 B2
(45) Date of Patent: Oct. 26, 2021

(54) MM-WAVE WIRELESS CHANNEL CONTROL USING SPATIALLY ADAPTIVE ANTENNA ARRAYS

(71) Applicants: Mustafa Harun Yilmaz, Tampa, FL (US); Ertugrul Guvenkaya, Carlsbad, CA (US); Gokhan Mumcu, Tampa, FL (US); Huseyin Arslan, Tampa, FL (US)

(72) Inventors: Mustafa Harun Yilmaz, Tampa, FL (US); Ertugrul Guvenkaya, Carlsbad, CA (US); Gokhan Mumcu, Tampa, FL (US); Huseyin Arslan, Tampa, FL (US)

(73) Assignee: University of South Florida, Tampa, FL (US)

( * ) Notice: Subject to any disclaimer, the term of this patent is extended or adjusted under 35 U.S.C. 154(b) by 215 days.

(21) Appl. No.: 15/811,193

(22) Filed: Nov. 13, 2017

(65) Prior Publication Data

US 2018/0131089 A1 May 10, 2018

Related U.S. Application Data

(60) Provisional application No. 62/420,162, filed on Nov. 10, 2016.

(51) Int. Cl.

| | |
|---|---|
| ***H01Q 3/26*** | (2006.01) |
| ***H01Q 1/24*** | (2006.01) |
| ***H01Q 21/22*** | (2006.01) |
| ***H01Q 3/04*** | (2006.01) |
| ***H01Q 3/36*** | (2006.01) |
| ***H01Q 1/12*** | (2006.01) |
| ***H01Q 21/06*** | (2006.01) |

(52) U.S. Cl.

CPC ..... *H01Q 3/2605* (2013.01); *H01Q 1/1257* (2013.01); *H01Q 1/24* (2013.01); *H01Q 1/246* (2013.01); *H01Q 3/04* (2013.01); *H01Q 3/26* (2013.01); *H01Q 3/267* (2013.01); *H01Q 3/36* (2013.01); *H01Q 21/065* (2013.01); *H01Q 21/22* (2013.01)

(58) Field of Classification Search

CPC ..... H01Q 3/2605; H01Q 3/36; H01Q 3/04; H01Q 1/24; H01Q 1/1257; H01Q 21/22; H01Q 3/267

USPC ..... 343/757

See application file for complete search history.

(56) References Cited

U.S. PATENT DOCUMENTS 4,425,567 A * 1/1984 Tresselt ..... H01Q 25/02 342/373

4,937,585 A * 6/1990 Shoemaker ..... H01Q 3/36 343/700 MS (Continued)

OTHER PUBLICATIONS

Bottomley, Channel Equalization for Wireless Communications: From Concepts to Detailed Mathematics. Wiley-IEEE Press, Jul. 2011.

(Continued)

*Primary Examiner* — Hai V Tran

(74) *Attorney, Agent, or Firm* — Meunier Carlin & Curfman LLC

(57) ABSTRACT

System and method for determining a position of an antenna array for optimal wireless communication. The system includes a spatially adaptive and beam-steering antenna array configured to control a wireless communications path between a first element and a second element based on a determination of wireless channel gain.

9 Claims, 5 Drawing Sheets

(56) References Cited

U.S. PATENT DOCUMENTS

| | | | | |
|---|---|---|---|---|
| 5,134,416 | A * | 7/1992 | Cafarelli | G01S 1/022 342/372 |
| 5,973,638 | A * | 10/1999 | Robbins | H01Q 3/267 342/171 |
| 6,304,214 | B1 * | 10/2001 | Aiken | H01Q 3/2605 342/362 |
| 7,120,468 | B1 * | 10/2006 | Wilhoyte | H01Q 3/2605 455/562.1 |
| 8,532,078 | B2 * | 9/2013 | Shapira | H04B 7/2681 370/338 |
| 9,350,426 | B2 * | 5/2016 | Zhang | H04B 7/082 |
| 9,615,266 | B1 * | 4/2017 | Cheadle | H04W 16/28 |
| 9,716,313 | B1 * | 7/2017 | Mumcu | H01Q 3/02 |
| 2003/0020915 | A1 * | 1/2003 | Schueller | B01L 3/5027 356/436 |
| 2007/0282221 | A1 * | 12/2007 | Wang | A61B 10/0233 600/564 |
| 2012/0007778 | A1 * | 1/2012 | Duwel | H01Q 3/446 342/368 |
| 2013/0176177 | A1 * | 7/2013 | Cetiner | H01Q 9/0414 343/700 MS |
| 2016/0112147 | A1 * | 4/2016 | Seo | H04B 7/088 375/224 |
| 2020/0150324 | A1 * | 5/2020 | Tabirian | G02B 3/0081 |

OTHER PUBLICATIONS

Dey et al., "Microfluidically controlled frequency-tunable monopole antenna for high-power applications," IEEE Antennas and Wireless Propagation Letters, vol. 15, pp. 226-229, 2016.

"Further Advancements for E-UTRA Physical Layer Aspects, 3GPP TR 36.814 V9.0.0 Std., Mar. 2010."

Gheethan et al., "Passive feed network designs for microfluidic beam-scanning focal plane arrays and their performance evaluation," IEEE Transactions on Antennas and Propagation, vol. 63, No. 8, pp. 3452-3464, 2015.

Goldsmith, Wireless Communications. Cambridge, U.K.: Cambridge Univ. Press, 2005.

Jin et al., "Ergodic rate analysis for multipair massive MIMO two-way relay networks," IEEE Trans. Wireless Commun., vol. 14, No. 3, pp. 1480-1491, 2015.

Palomo et al., "Microfluidically reconfigurable metallized plate loaded frequency-agile rf bandpass filters," IEEE Transactions on Microwave Theory and Techniques, vol. 64, No. 1, pp. 158-165, 2016.

Rangan et al., "Millimeter-wave cellular wireless networks: Potentials and challenges," Proceedings of the IEEE, vol. 102, No. 3, pp. 366-385, Mar. 2014.

Yilmaz et al., "Joint subcarrier and antenna state selection for cognitive heterogeneous networks with reconfigurable antennas," IEEE Trans. Commun., vol. 63, No. 11, pp. 4015-4025, Nov. 2015.

* cited by examiner

FIG. 4A
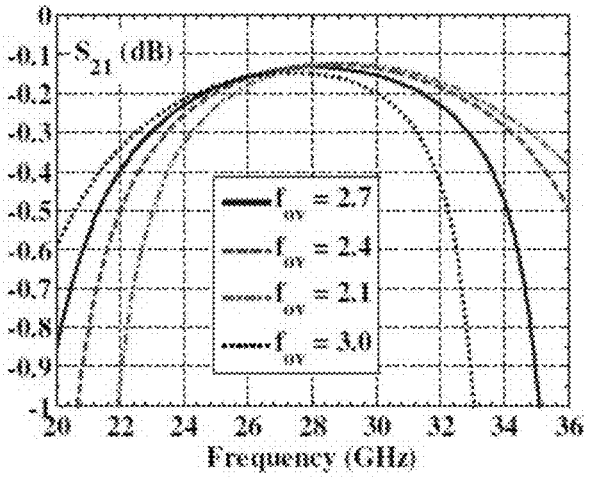
FIG. 4B
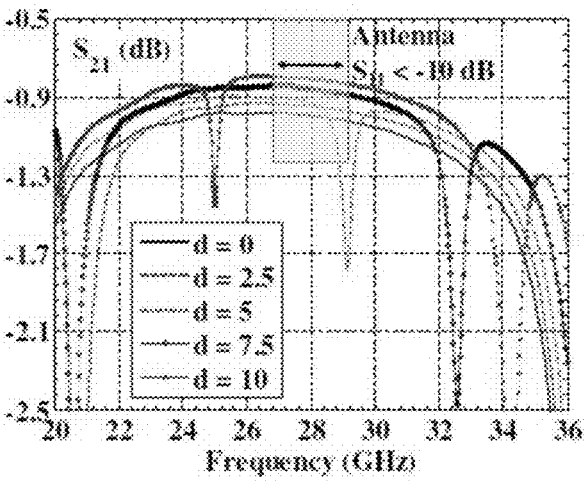
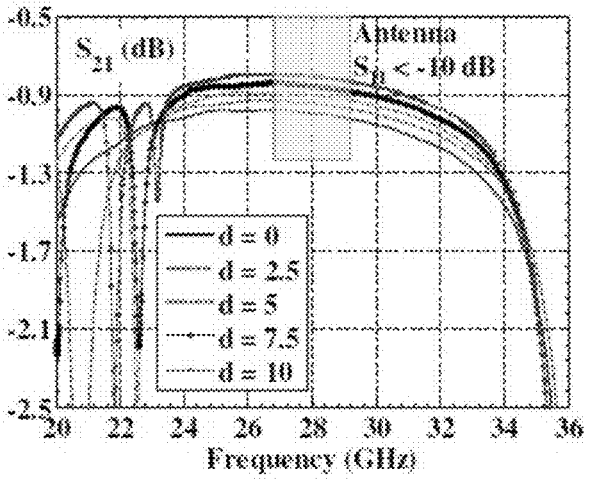
FIG. 4C
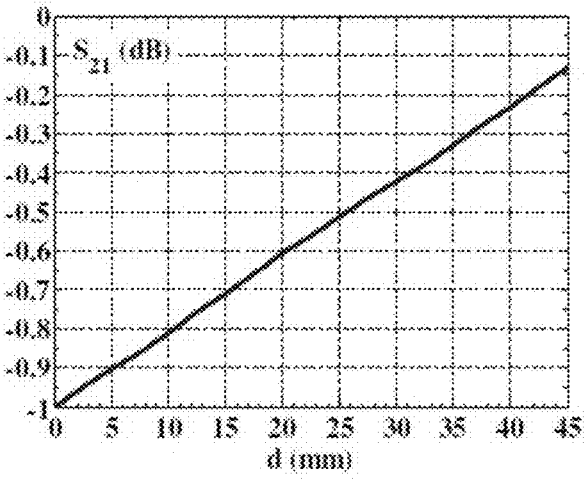
FIG. 4D

FIG. 6A
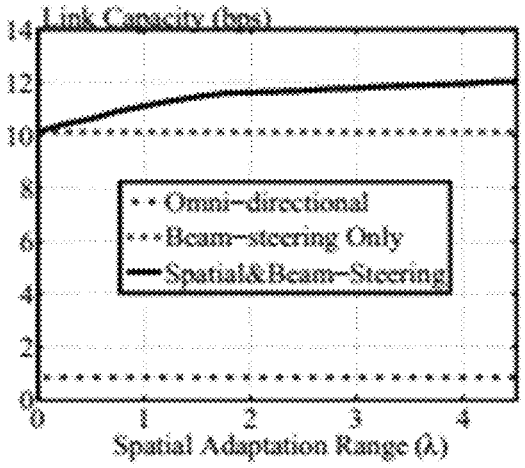
FIG. 6B
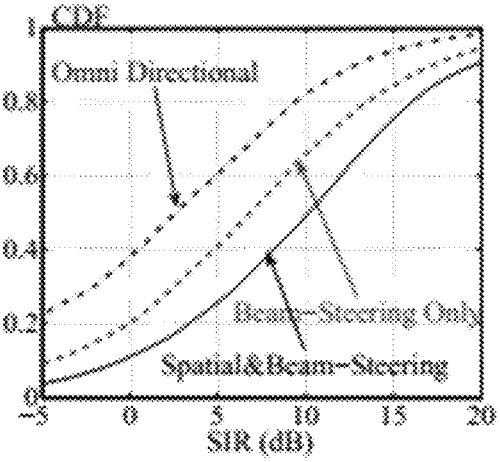
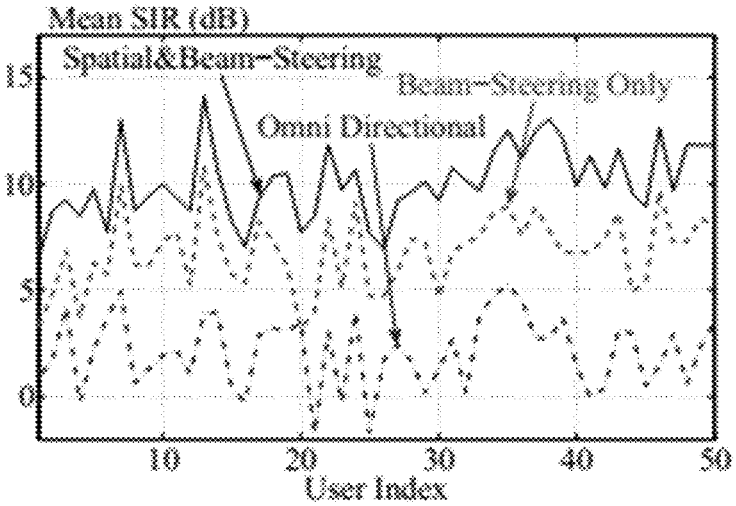
FIG. 6C

MM-WAVE WIRELESS CHANNEL CONTROL USING SPATIALLY ADAPTIVE ANTENNA ARRAYS

CROSS-REFERENCE TO RELATED APPLICATION(S)

This application is a non-provisional of and claims priority to U.S. Provisional Application No. 62/420,162, filed on Nov. 10, 2016, the contents of which are incorporated herein by reference.

STATEMENT REGARDING FEDERALLY SPONSORED RESEARCH OR DEVELOPMENT

This invention was made with government support 1609581 awarded by the National Science Foundation. The Government has certain rights to the invention.

BACKGROUND OF THE INVENTION

Wireless channel formation is conventionally accepted as an uncontrollable phenomenon since the physical environment and propagation scenario that determine the fading and time-varying response are assumed to be random. Wireless communication techniques treat the channel response as a given parameter and try to compensate the fading and distortion via equalization and/or benefit from multitudes of independent channels by employing multiple antennas. This causes overall performance of the state-of-the-art techniques to depend on the randomness level of the wireless channel. To increase the data rates beyond the state of the art, the proposed effort challenges the fundamental perception of the "uncontrollable wireless channel" with the novel concept of "wireless channel control via simultaneous high gain beam-steering and antenna array positioning".

SUMMARY OF THE INVENTION

In contrast to the traditional wireless spectrum below 6 GHz, small wavelengths of mm-wave bands make physical displacements on the order of several wavelengths practically achievable within compact devices. Based on this observation, a wireless channel control concept utilizing spatially (i.e., position) adaptive antenna arrays is disclosed herein. The main principle relies on the fact that phase of each multipath component is affected by the position of the antenna array. The system level objective is therefore to find the best array position that will provide a constructive combination of the individual components for maximizing the received signal power and reduce fading, especially in narrowband systems. For broadband systems, controlling the channel reduces the burden on the scheduler by finding the better channel for the same resource(s) allocated to a user. Additionally, this concept provides an additional degree of freedom for the system and increases the reliability with spatial diversity via displacing the antenna array spatially.

To carry out this control concept, microfluidically reconfigurable RF devices are employed in an embodiment of the invention. Repositionable selectively metalized plates are utilized inside microfluidic channels bonded to printed circuit board (PCB) substrates to realize wideband frequency tunable antennas, filters, and mm-wave beam-steering focal plane arrays. As compared to a mechanical assembly, a microfluidics based approach requires movement of a lower mass (i.e., a selectively metalized plate defining the antennas) by allowing the feed network to remain stationary. This results in low-cost, compact, and efficient devices.

Embodiments of the invention employ a technique that simultaneously utilizes beam-steering and spatial adaptation to enhance the wireless channel gain and system capacity. Microfluidically reconfigurable RF devices are utilized as they can enable compact systems with spatial adaptation capability. Specifically, a five element linear 28 GHz mm-wave antenna array design that can achieve beam-steering via phase shifters and spatial adaptation via microfluidics is disclosed. Simulated realized gain patterns at various array positions and phase shifter states are subsequently utilized in link and system level simulations to demonstrate the advantages of the invention. It is shown that the wireless communications system observes 51% gain in the mean SIR due to the inclusion of spatial adaptation capability.

In one embodiment, the invention provides a wireless communication technique that employs a single, adaptable antenna to compensate for fading and distortion. Such fading and distortion are typically solved by utilizing a multitude of independent communication channels using multiple antennas. This invention uses microfluidics and phase change to adapt an antenna to an efficient configuration for mm wave communication. This invention can be placed within compact devices to provide less fading and distortion and higher communication throughput. An embodiment of this invention provides wireless channel control through the simultaneous use of beam-steering to change phase and microfluidics to change antenna positioning.

In another embodiment, the invention provides a method of optimizing phase shifting and antenna positioning to achieve significant improvement in signal-to-interference ratio. Such improvement in this embodiment improves communication throughput and reduces error rates. Such an embodiment can be embodied on small devices making it broadly useable across devices communicating in mm-scale ranges. Such embodiment allows communication in situations where signal-to-noise ratios previously made communication unreliable or even impossible.

In yet another embodiment, the invention provides a system comprising a spatially adaptive and beam-steering antenna array configured to control a wireless communications path between a first element and a second element based on a determination of wireless channel gain.

In a further embodiment, the invention provides an antenna system comprising an array of antenna elements and a microfluidics device in communication with the antenna elements. The microfluidics device is configured to adjust a vertical position of the array. The microfluidics device operates together with a phase shift device to determine an optimal position of the array to provide greatest capacity in signal gain.

Other aspects of the invention will become apparent by consideration of the detailed description and accompanying drawings.

BRIEF DESCRIPTION OF THE DRAWINGS

FIG. 4A is a graphical illustration of $S_{21}$ performance of the feed network for various overlap length $f_{ov}$ values (reference plane is taken for feed transition).

FIG. 4B is a graphical illustration of $S_{21}$ performance of the feed network for no grounding pads and vias.

FIG. 4C is a graphical illustration of $S_{21}$ performance of the feed network for grounding pads and vias.

FIG. 4D is a graphical illustration of $S_{21}$ performance of the feed network for different array positions d (reference plane is taken for feed loss evaluation).

FIG. 6A is a graphical illustration of link capacity vs. spatial adaptation range.

FIG. 6B is a graphical illustration of SIR gains of wireless systems utilizing different types of antennas at BSs.

FIG. 6C is a graphical illustration of mean SIR gains of each individual user within the wireless systems.

DETAILED DESCRIPTION

Figure 1:
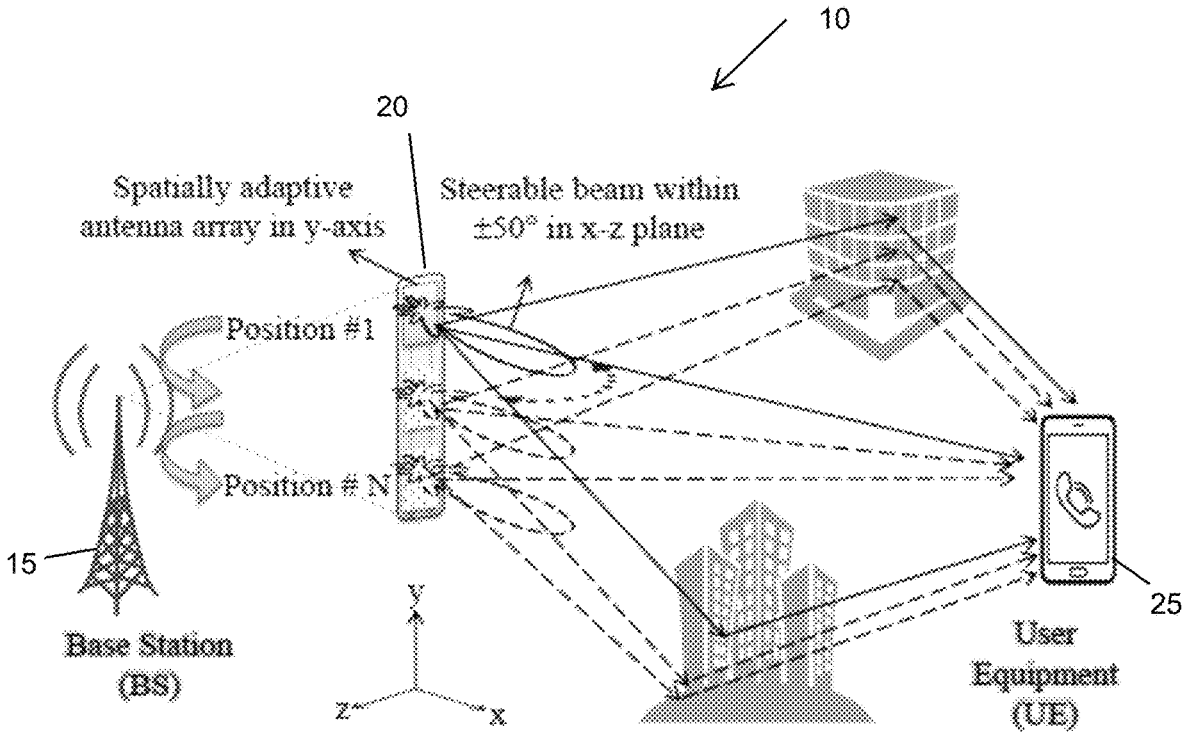
FIG. 1 is a schematic illustrating a base station (BS) changing position of the antenna array to maximize signal power and reduce fading.

Before any embodiments of the invention are explained in detail, it is to be understood that the invention is not limited in its application to the details of this construction, including the arrangement of components, number of components, dimensions of components and their configurations, and overall system interconnections set forth in the following description or illustrated in the following drawings. The invention is capable of other embodiments and of being practiced or of being carried out in various ways.

Initially, it is noted that the high frequency of millimeter waves and their propagation characteristics (that is, the ways they change or interact with the atmosphere as they travel) make them useful for a variety of applications, such as, for example, transmitting large amounts of computer data, cellular communications, and radar. Every kind of wireless communication, such as the radio, cell phone, or satellite, uses specific range of wavelengths or frequencies. Each application provider (such as a local television or radio broadcaster) has a unique "channel" assignment, so that they can all communicate at the same time without interfering with each other. These channels have "bandwidths" (also measured in either wavelength or frequency) that must be large enough to pass the information from the broadcaster's transmitter to the user. For example, a telephone conversation requires only about 6 kHz of bandwidth, while a TV broadcast, which carries much larger amounts of information, requires about 6 MHz. Increases in the amount of information transmitted require the use of higher frequencies. Accordingly, the use of millimeter waves and their high frequency makes them a very efficient way of sending large amounts of data such as computer data, or many simultaneous television or voice channels.

The channel control concept described below using millimeter waves employs microfluidically reconfigurable RF devices. Repositionable selectively metalized plates have been utilized inside microfluidic channels bonded to printed circuit board (PCB) substrates to realize wideband frequency tunable antennas, filters, and mm-wave beam-steering focal plane arrays. As compared to a mechanical assembly, a microfluidics based approach requires movement of a lower mass (i.e., a selectively metalized plate defining the antennas) by allowing it to keep the feed network stationary. This is expected to result in low-cost, compact, and efficient devices.

The advantages of this channel control concept are demonstrated with a wireless communication system model at 28 GHz in which a base station (e.g., a cellular communications tower) and user device (e.g., cellular phone, smart phone, tablet, computer or other personal devices) employ spatially adaptive antenna arrays and omni-directional antennas, respectively. In one example, the base station is considered to employ a five element linear antenna array that can achieve beam-steering via phase shifters and spatial adaptation via microfluidics. Once the signal-to-interference ratio (SIR) and capacity measurements are carried out for the combination of positions and beam-steering directions, the receivers select the position and beam-steering direction that provides the highest capacity.

FIG. 1 illustrates a schematic diagram of a wireless communication system 10 for enhancing wireless channel gain and system capacity according to an embodiment of the present invention. The system 10 includes a base station 15 having an antenna array 20 and a user device 25. The antenna array 20, in this embodiment, includes components (discussed below) that allow the antenna array 20 to be spatially adaptive. The base station 15 also includes a transmitter and a receiver along with other components necessary to transmit and receive electromagnetic waves (e.g., 30 GHz to 300 GHz).

FIG. 1 further illustrates the downlink scenario in which a base station 15 is equipped with a spatially adaptive linear antenna array 20, and a user device 25 is equipped with an omni-directional antenna. The spatially adaptive antenna array 20 is capable of changing its position along the y-axis using microfluidics and performing beam-steering in the orthogonal x-z plane using phase shifters.

With continued reference to FIG. 1, after passing through the wireless multipath channel, the transmitted signal x(t) is received at the user device 25 as $$y(t;d)=x(t)*h(t,\tau;d)+w(t), \tag{1}$$

where h(t, τ; d) is the channel response between transmitter and receiver including the radiation pattern and the multipath reflections, d is the spatial offset of the transmitter antenna array, τ is the delay and w(t) is the additive white Gaussian noise. In a directional transmit (tx) or receive (rx) scenario, the resulting channel response is determined by the weighted sum of the taps as $$h(t,\tau;d)=\sum_{k=1}^{K}\sum_{l=1}^{L} g_{kl}(t,\tau;d)u_{tx}(\theta_k^{tx}(d))\times u_{rx}(\theta_k^{rx}(d))\delta(\tau-\tau_{kl}), \tag{2}$$

where l is the path index, L is the total number of paths, $g_{kl}(t, \tau; d)$ is the complex channel gain of lth path of kth cluster, and $u(\theta_k(d))$ is antenna gain factor as a function of the departure/arrival angle of the tx/rx signal path. In this scenario, the multipath environment itself is considered to be time invariant. Thus, the only source of change in the multipath response is the spatial offset d of the transmitter antenna array 20. Therefore, the time variable can be substituted into the offset value (i.e., d(t)). In addition, the bandwidth of the signal is considered not to be sufficiently large enough for resolving each path in a cluster. Thus, the paths in each cluster are combined to constitute one tap per cluster as would be valid in indoor environments. Consequently, by dropping the path dependency in multipath delays via $\tau_{kl} \approx \tau_k$, the channel response can be further simplified as $$h(\tau; d) = \sum_{k=1}^{K} g_k(\tau; d) u_{tx}(\theta_k^{tx}(d)) u_{rx}(\theta_k^{rx}(d)) \delta(\tau - \tau_k). \quad (3)$$

Mm-wave channels are known to be sparse. Therefore, small alterations in the antenna location in the range of a few wavelengths is expected to vary the phase of each tap coefficient due to change in total propagation distance. This sparse nature of the mm-wave multipath channel is an important factor that makes the control of the overall channel response via spatial adaptation possible.

Figure 2A:
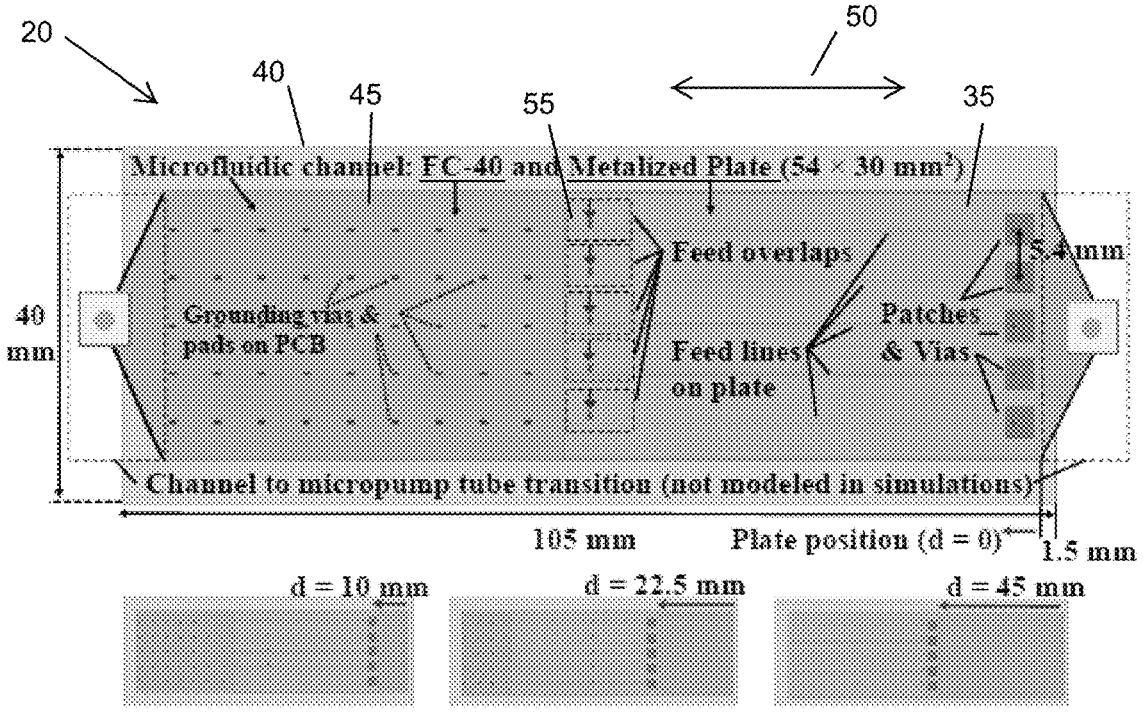
FIG. 2A illustrates a five element linear patch antenna array that can perform spatial (i.e., position) adaptation using microfluidics.
Figure 2B:
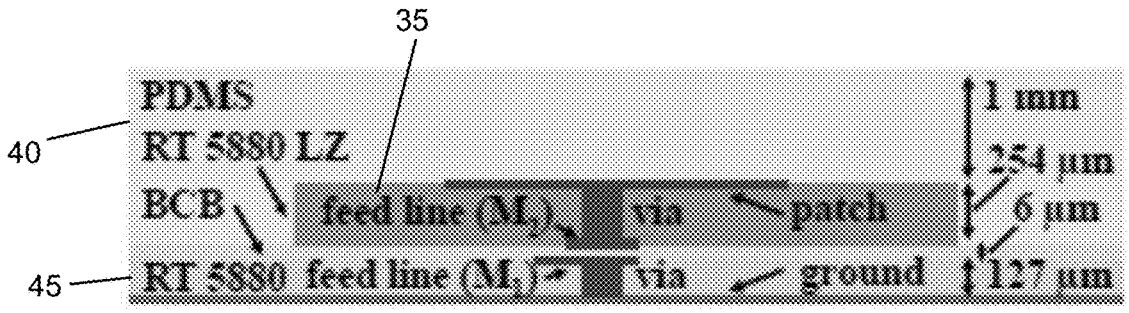
FIG. 2B illustrates a substrate stack-up in which a first circuit board is located inside a microfluidic channel.

FIGS. 2A-B illustrate the antenna array 20 according to an embodiment of the present invention. In particular, FIGS. 2A-B illustrate the structure and substrate stack-up of a 5 element linear 28 GHz patch antenna array that is considered for the performance evaluation of the wireless channel control concept discussed herein. In this construction of the antenna array 20, a circuit board 35 (e.g., a 254 μm thick 54×30 $mm^2$ RT5880LZ PCB ($\epsilon_r$=1.96, tan δ=0.0027)) acts as a selectively metalized plate placed inside a microfluidic channel 40 that is prepared within 1 mm thick polydimethylsiloxane (PDMS, $\epsilon_r$=2.7, tan δ=0.04). The remaining volume of the microfluidic channel 40 is filled with a low-loss dielectric solution (e.g., FC-40, $\epsilon_r$=1.9, tan δ=0.0005). With reference to FIG. 2B (which illustrates one patch antenna and its components, but it is noted that other patch antennas are included with similar components), the top surface of the circuit board 35 carries the patch antenna, and the bottom surface of the circuit board 35 carries a 50Ω microstrip feed line ($M_2$) metallization pattern. The feed line $M_2$ is electrically connected to the patch antenna with a via.

With continued reference to FIG. 2B, the microfluidic channel 40 is bonded to a circuit board 45 (e.g., a 127 μm thick 105×40 $mm^2$ RT5880 PCB ($\epsilon_r$=2.2, tan δ=0.0009)) using a 6 μm thick benzocyclobutene (BCB, $\epsilon_r$=2.65, tan δ=0.0008) layer. The top surface of the circuit board 45 carries the stationary microstrip feed lines ($M_1$), grounding pads ($M_1$), and vias. Its bottom surface is the ground plane of the antenna array 20. One or more micropumps (e.g., piezoelectric) in fluid communication with the microfluidic channel 40 drive a closed loop fluid system and generate the necessary flow to move/reposition the circuit board 35 (in the direction of arrow 50) inside the microfluidic channel 40. As illustrated in FIG. 2A, d=0 mm indicates that the circuit board 35 located inside the microfluidic channel 40 is at its furthest position relative to the input/output RF ports 55 of the stationary feed network ($M_1$ that links to the transmitter or receiver). Additionally, d=45 mm indicates that the circuit board 35 located inside the microfluidic channel 40 is at its closest position to the input/output RF ports 55 of the stationary feed network. FIG. 2A also illustrates the state of the circuit board 35 inside the microfluidic channel 40 at d=10 mm, d=25 mm, and d=45 mm positions.

Figure 3:
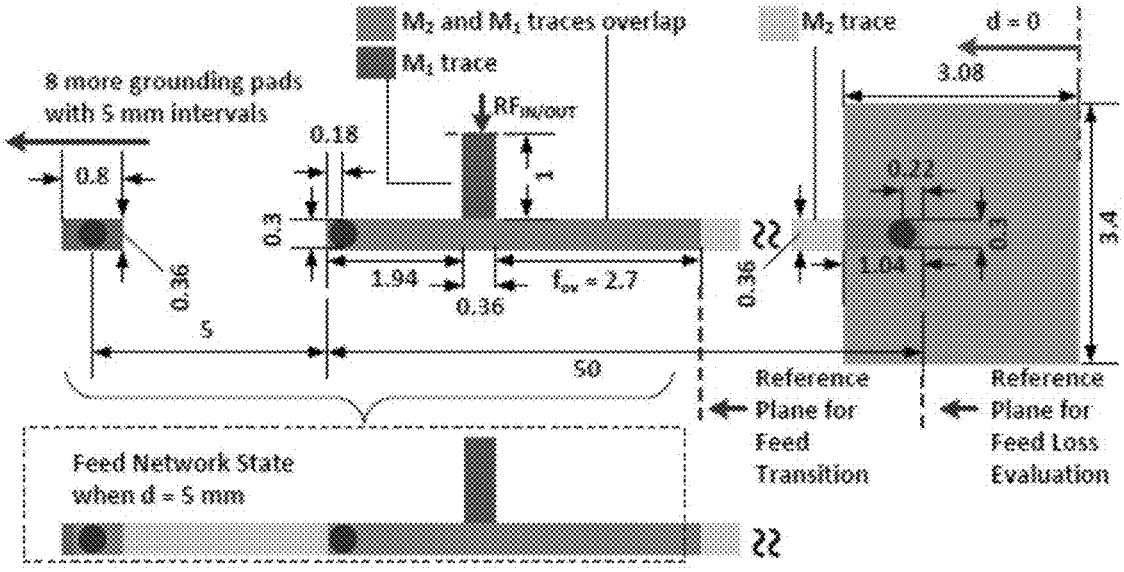
FIG. 3 illustrates a detailed layout of the antenna, feed network, and grounding vias (units: mm).
Figure 5A:
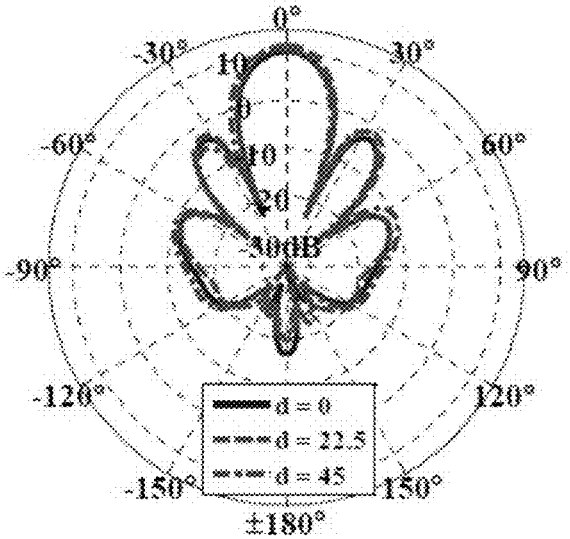
FIG. 5A illustrates simulated x-z plane realized gain patterns of the antenna array at various d positions for progressive phase shifts of $\beta=0$.
Figure 5B:
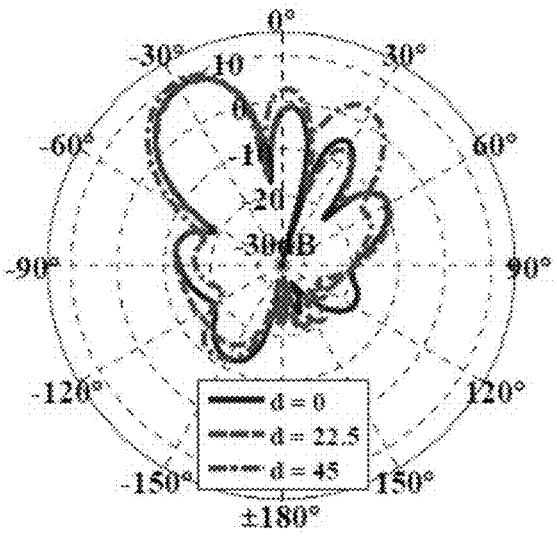
FIG. 5B illustrates simulated x-z plane realized gain patterns of the antenna array at various d positions for progressive phase shifts of $\beta=\pi/4$.
Figure 5C:
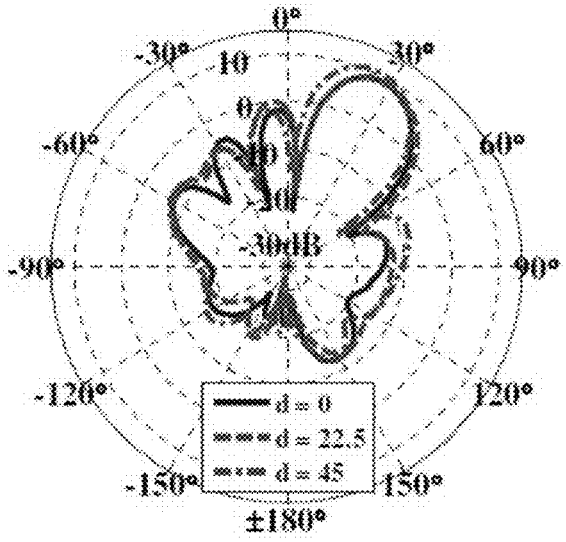
FIG. 5C illustrates simulated x-z plane realized gain patterns of the antenna array at various d positions for progressive phase shifts of $\beta=-\pi/4$.
Figure 5D:
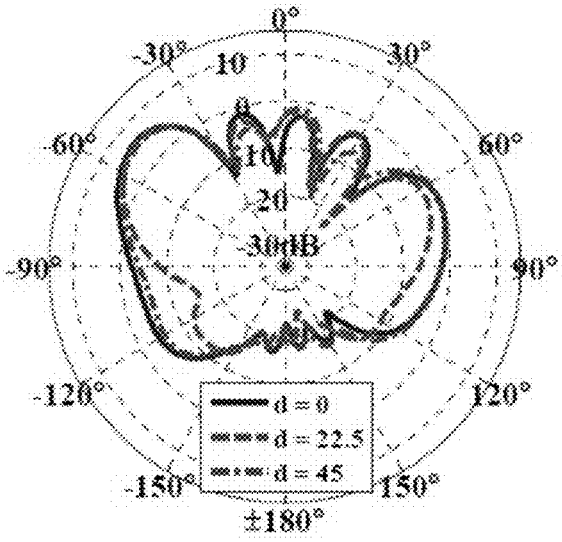
FIG. 5D illustrates simulated x-z plane realized gain patterns of the antenna array at various d positions for progressive phase shifts of $\beta=7\pi/8$.

FIG. 3 shows the layout details of the antenna array 20 and the stationary feed network (e.g., the feed lines to a transmitter or a receiver). In a physical device implementation, the input/output RF port 55 of the stationary feed network ($M_1$ trace) is expected to be interconnected with other PCB layers that are hosted under the ground plane of the antenna array 20 and interface with digital phase shifters. The thin BCB insulator between the $M_1$ trace and the feed line inside the microfluidic channel ($M_2$ trace) allows for strong capacitive coupling in overlapping regions. This is utilized for passing the RF signal between the two traces without making physical electrical contact.

The feed line design is carried out using Momentum Suite of the Keysight's Advanced Design System (ADS) software due to its accuracy and effectiveness in handling planar layered geometries. Fifty ohm (50Ω) microstrip lines are designed for the selected substrate stack-up using the procedure outlined in Gheethan et al., "Passive feed network designs for microfluidic beam-scanning focal plane arrays and their performance evaluation," IEEE Transactions on Antennas and Propagation, vol. 63, no. 8, pp. 3452-3464, 2015. As shown in FIG. 3, the feed lines $M_1$ and $M_2$ maintain a constant overlap length ($f_{ov}$) of 2.7 mm at any d position of the moving circuit board 35. A 1.94 mm long (≈λ/4, where λ, is the free-space wavelength of 10.71 mm at 28 GHz) short-ended stub is placed to create an open circuit condition at one end of the T-junction to fully direct the signal from RF port to antenna, and vice versa. As depicted in FIG. 4A, $f_{ov}$ affects the bandwidth of the feed network and is selected to get the largest $S_{21}$<−0.5 dB bandwidth around 28 GHz (where $S_{21}$ is a scattering parameter well known to a person of ordinary skill in the art). As the circuit board 35 inside the microfluidic channel 40 moves to greater d positions, the open-ended $M_2$ trace that remains outside of the overlap area exhibits resonances that hinder the functionality of the feed network (see FIG. 4B). This issue is alleviated in this construction by grounding the $M_2$ trace in five mm periods using grounding pads and vias over the circuit board 35 of the stationary feed network (see FIG. 4C). FIG. 4D demonstrates the $S_{21}$ performance of the feed network at 28 GHz as the circuit board 35 inside the microfluidic channel 40 is positioned from d=0 mm to d=45 mm. As seen, the loss is linearly proportional to the feed line length and 0.15 dB loss at d=0 mm implies the effectiveness of the designed feed transition.

Antenna array design is carried out with Ansys HFSS v16.2 to account for the finite substrate and ground plane effects. The patch antenna element of the array has a footprint of 3.4×3.08 mm2 and resonates at 28 GHz with a 3.2 GHz of $S_{11}$<−10 dB bandwidth (where $S_{11}$ is a scattering parameter well known to a person of ordinary skill in the art). The element separation within the array is 5.4 mm and corresponds to λ/2. The radiation efficiency is 80% when the array is located at its closest position (i.e., d=45 mm) to the RF ports 55 and primarily affected by the dielectric loss of the PDMS mold that forms the microfluidic channel 40. In this position, the uniformly excited array exhibits 11.1 dB realized broadside gain with 200 half-power-beamwidth (HPBW) in the x-z plane. A lower radiation efficiency is attained when the array moves to different positions due to the increased feed line loss. The realized gain of the array drops by ~5 dB as the beam is scanned to β=±500 from the broadside using a progressive phase shift of β=±7π/8. This 100° range is taken as the FoV of the array. To represent the beam-steering performance accurately, 15 different realized gain patterns were extracted by varying β in π/8 increments which is also possible to accomplish with commercially available discrete phase shifters. The array position is varied with d=2.5 mm (i.e., ~λ/4) increments to sample both correlated and uncorrelated wireless channel gains. Consequently, the total dataset obtained from full-wave electromagnetics simulations consists of 285 realized gain patterns. FIGS. 5A-D depict representative patterns for various β and d combinations. It is observed that the main lobe characteristic of the radiation pattern is mostly independent of the array position. Therefore, the feed network loss is the major parameter that affects the performance of the array as it is spatially adapted.

To demonstrate the advantage of the control concept in the link level, an environment is considered where 800λ×800λ multipath reflection region with scatterers is placed in between a base station and a user device separated 2000λ apart. The number of scatterers is randomly selected from the Poisson distribution in each iteration of the link level simulation (between 2-4). A path loss model and the scenario parameters are adopted from Rangan, et al., "Millimeter-wave cellular wireless networks: Potentials and challenges," Proceedings of the IEEE, vol. 102, no. 3, pp. 366-385, March 2014, and is given as $PL(dB)=\alpha+\beta 10 \log_{10} r_0$ where $r_0$ is the distance, α is the best fit floating point (α=72) and β is the slope of best fit (β=2.92). Different channels are achieved for a base station by spatially displacing the antenna array position as given in (eq. 3). FIG. 6A depicts the link capacity in terms of spectral efficiency at mean SNR=0 dB as the spatial adaptation range of the antenna array in the base station is increased from 0λ (i.e., no adaptation) to 4.5λ. The "beam-steering only" scenario uses the realized gain performance of antenna array positioned at d=45 mm (i.e., best radiation efficiency) and performs beam angle adaptations based on the observed channel gain. On the other hand, a "spatial & beam-steering" scenario harnesses beam angle and position adaptations simultaneously to maximize channel gain. The link capacity increases with the spatial adaptation range of the antenna array. FIG. 6A also depicts the advantages of using directional beam-steering arrays over omni-directional antennas to beat the path loss effect in mm-wave communications.

The system level advantage of the control concept disclosed herein is demonstrated by considering a scenario in which 50 small cells are randomly distributed within a 200×200 $m^2$ area with each base station serving a single user device. The transmit power of each base station is considered as 30 dBm which is taken from Further Advancements for E-UTRA Physical Layer Aspects, 3GPP TR 36.814 V9.0.0 Std., March 2010. Each base station is assumed to be selfish, i.e., there is no coordination between small base stations. In narrowband systems, it is also assumed that all base stations allocate the same resource at the same time.

A game theoretical framework is established as in Yilmaz et al., "Joint subcarrier and antenna state selection for cognitive heterogeneous networks with reconfigurable antennas," IEEE Trans. Commun., vol. 63, no. 11, pp. 4015-4025, November 2015. However, in this framework, base stations are modeled to perform simultaneous array position and beam angle selection affecting the received signal strength (RSS) evaluation. This joint behavior also provides interference management in the system. In addition, equation (3) is adapted for modeling wireless channels. The same framework is also modeled with a beam-steering only array for comparison. Every base station searches for the best antenna position and state in terms of SIR. The results are drawn when the system reaches the equilibrium. Similar to link level results, the distribution of a spatially adaptive array provides better performance than beam-steering only antenna arrays under the interference coming from the other users in the environment. FIG. 6B shows the cumulative distribution function (CDF) of the SIR results. In the mean SIR value, spatially adaptive antenna arrays achieve 51% improvement with respect to beam-steering only arrays. FIG. 6C indicates the mean SIR difference in each user separately and presents the advantage of the spatially adaptive arrays per user case. The spatially adaptive arrays can provide increases in SIR up to 5.4 dB as compared to the beam-steering only arrays.

A wireless channel control concept based on spatial adaptation of antenna arrays has been disclosed. Small wavelengths at mm-wave bands make it possible to apply this concept within compact devices. Recently introduced microfluidically reconfigurable RF devices can achieve these spatial adaptations efficiently and in a simple way by keeping the feed networks and control devices (such as phase shifters) stationary. In one example, a five element 28 GHz antenna array design that achieves spatial adaptation over a 4.5λ distance via microfluidics was discussed. Subsequently, its performance was utilized in an example wireless link and system level scenarios. This spatially adaptive antenna array provided 1 bps capacity gain over its traditional counterpart. In addition, 51% increment in the mean SIR can be obtained in the wireless communications system when the antenna array acquired the spatial adaptation capability.

As noted above, a mechanical assembly according to one embodiment of the invention is described to move the antenna array. The antenna array may be moved by other devices or assemblies, such as, for example, with a motor. In addition, the angle of the antenna array may be adjusted, for example, by using a phase shifter, a mechanical assembly, or a parasitic element. One example of a parasitic element comprises a passive reflector or director loaded with switches and/or varactor diodes.

Various features and advantages of the invention are set forth in the following claims.

What is claimed is:

1. A system comprising:

a spatially adaptive antenna array, wherein the antenna array is configured to control a wireless communications multipath channel between a transmitter and a receiver based on a determination of wireless channel gain by physically changing a position of the antenna array along a first vertical axis from a first location in the first vertical axis to a second location in the first vertical axis and performing beam-steering, wherein physically changing the position of the antenna array comprises spatially displacing the position of the antenna array.

2. The system of claim 1, wherein the spatially adaptive antenna array is further configured to physically change its own position and a beam-steering angle based on feedback that evaluates the wireless channel gain.

3. The system of claim 2, wherein the feedback comprises a received signal strength, a signal-to-interference-noise ratio, signal-to-interference ratio, signal-to-noise ratio, capacity or throughput.

4. The system of claim 2, wherein the spatially adaptive antenna array is repositioned using microfluidics.

5. The system of claim 2, wherein only the antenna array is repositioned over a stationary feed network that passes RF signal from/to moving metallizations through RF coupling.

6. The system of claim 1, further comprising a wireless channel controller positioned in a base station or a user device.

7. The system of claim 1, wherein the spatially adaptive antenna array is further configured to enable communication in mm-wave by providing access to different multipath channels in each physical position.

8. The system of claim 1, wherein the spatially adaptive antenna array is further configured to simultaneously utilize beam-steering and spatial adaptation to enhance wireless channel gain and system capacity.

9. The system of claim 1, wherein the spatially adaptive antenna array is further configured to provide the control via simultaneous use of beam-steering to change phase and microfluidics to change its own physical position.

* * * * *